United States Patent [19]

Kiss

[11] 4,058,914

[45] Nov. 22, 1977

[54] ALTERNATE FLOW SUCTION DREDGE

[76] Inventor: Sandor G. Kiss, 236 E. Sunset Ave., Lombard, Ill. 60148

[21] Appl. No.: 640,395

[22] Filed: Dec. 15, 1975

[51] Int. Cl.[2] ..... E02F 3/92

[52] U.S. Cl. ..... 37/66; 37/58; 37/DIG. 18

[58] Field of Search ..... 37/58, 71, 66, 67, DIG. 18

[56] References Cited

U.S. PATENT DOCUMENTS

| | | | |
|---|---|---|---|
| 477,827 | 6/1892 | Souther | 37/58 |
| 516,066 | 3/1894 | Titcomb | 37/58 |
| 548,242 | 10/1895 | Wood et al. | 37/58 |
| 1,701,430 | 2/1929 | Thurston | 37/66 |
| 1,754,746 | 4/1930 | Ewig | 37/58 |
| 1,777,575 | 10/1930 | Penney | 37/66 X |
| 2,160,761 | 5/1939 | Spadaro | 37/58 |
| 2,414,797 | 1/1947 | Brown | 37/58 |
| 2,762,136 | 9/1956 | Bell | 37/67 |
| 2,995,842 | 8/1961 | Korste | 37/58 |
| 3,171,220 | 3/1965 | Schram | 37/66 |
| 3,748,760 | 7/1973 | Schnell | 37/71 X |

FOREIGN PATENT DOCUMENTS

| | | | |
|---|---|---|---|
| 473,767 | 3/1929 | Germany | 37/66 |
| 724,906 | 2/1955 | United Kingdom | 37/DIG. 18 |
| 201,978 | 10/1967 | U.S.S.R. | 37/DIG. 18 |

*Primary Examiner*—Clifford D. Crowder

*Attorney, Agent, or Firm*—Elmer L. Zwickel; Eugene F. Friedman

[57] ABSTRACT

Suction dredges of a character having a flexibly mounted suction tube ladder provided on its free end with a suction head having dual mouths opening in opposite directions and a valve therein to afford selective opening of one or the other of the mouths. There is also a power driven auger to urge the suction head firmly against the work area.

9 Claims, 6 Drawing Figures

Fig. 1.
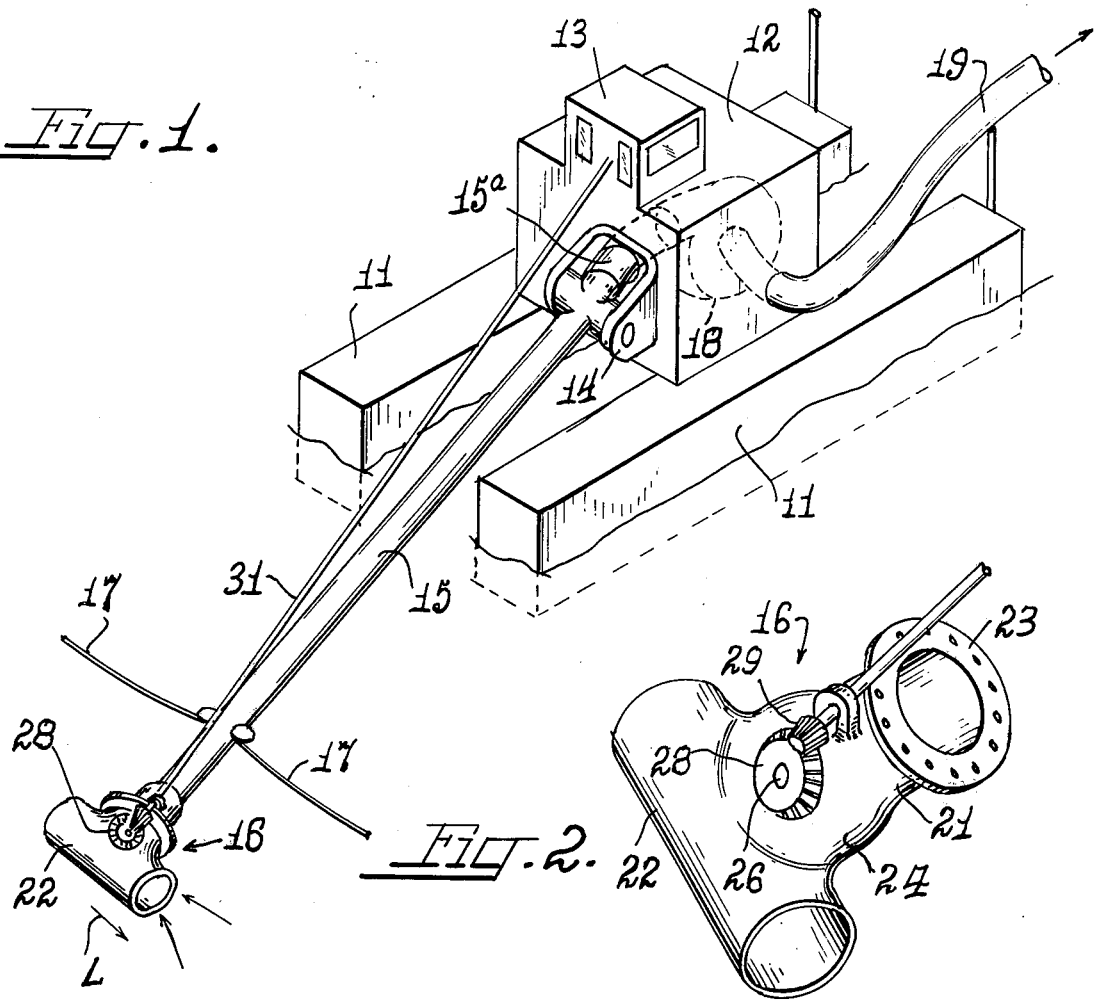
Fig. 2.
Fig. 4.
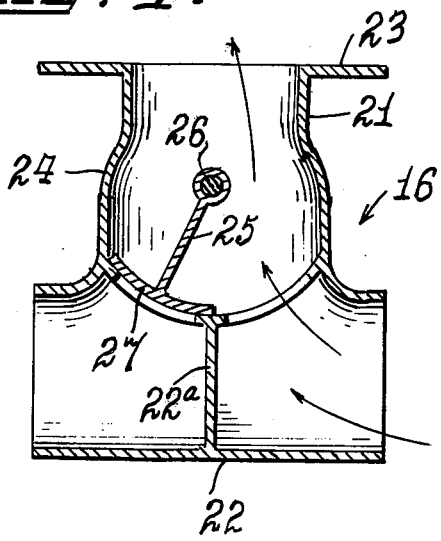
Fig. 3.
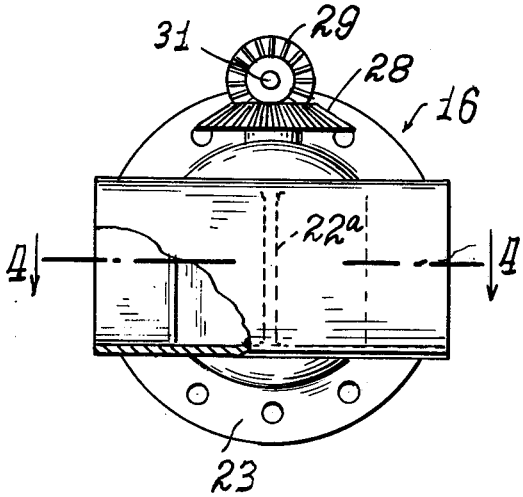

ALTERNATE FLOW SUCTION DREDGE

The invention pertains to alternate flow suction dredges and is more particularly concerned with the construction and function of a novel suction head. The suction head has two mouths disposed in opposite directions, one of which may be selectively closed so as to permit entry of slurry into the tube type ladder from one side or the other. Such entry control also assists in movement of the ladder and its suction head in the direction of the work area.

As is well understood, dredging often becomes difficult owing to the presence of hard surfaces (packed clay, etc.) in the area being dredged which tends to retard flow of slurry unless and until such surface is broken up. Heretofore, loosening of such hard surfaces depended solely upon the use of rotary cutters. In the present structure the rotary cutter is vibrated and also has means associated with it to positively urge it into surface of the work area.

The herein disclosed suction head is fabricated in one piece with an internal valve element that is controlled from the usual control center on the hull assembly so as to cause entry of slurry from one side or the other of the suction head, When the ladder is being swung through its arc, that is from right to left and vice-versa, the suction force generated at the open side of the suction head, which is on the side of the ladder advancing toward the work area, is effective to urge the ladder and suction head toward the work area. Thus there is not only maximum suction generated at the work area to loosen even hard substances but there is also applied a force that propels the suction head toward the work area to thereby minimize the effort required to swing the ladder through its arc.

It is therefore an object of this invention to provide an hydraulic suction dredge with a novelly constructed suction head.

Another object is to provide a suction head with oppositly disposed sludge entrances.

Another object is to provide a suction head with valve means to control the flow of slurry thereinto.

Another object is to provide novel means to propel the suction head toward the work area.

Another object is to provide an hydraulic suction dredge with a novelly constructed suction head which is not difficult or expensive to construct or maintain and one that is very efficient in use.

Other objects and advantages of the invention will become apparent with reference to the following description and accompanying drawing.

IN THE DRAWINGS:

FIG. 1 is a perspective view of a representative hydraulic suction dredge embodying the novel suction head.

FIG. 2 is a perspective view of the suction head and valve control mechanism.

FIG. 3 is a bottom end view of the suction head.

FIG. 4 is an axial sectional view of the suction head, taken substantially on line 4—4 of FIG. 3.

Figure 5:
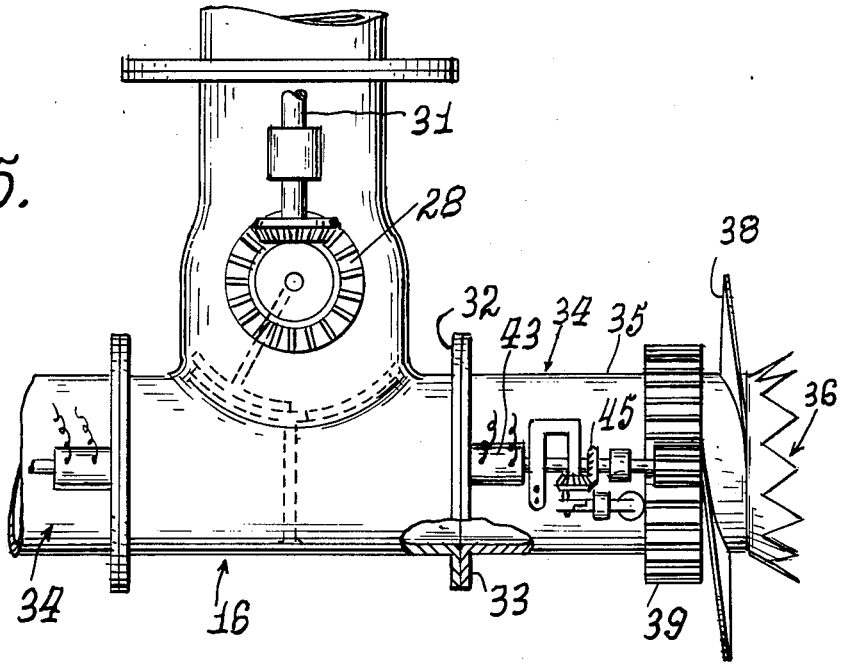
FIG. 5 is a plan view of a modified suction head, embodying positive cutter means and means to vibrate the said means

Referring to the exemplary illustration of an hydraulic suction dredge shown in FIG. 1, the dredge may comprise a hull including a pair of pontoon floats 11 having, jouned thereto and bridging the gap between them, a pump housing 12 upon which is superposed a control center 13. Moveably mounted on the front end of pump housing 12 is a swivel trunnion 14 to which one end of a tube type ladder 15 is journalled. The ladder includes a flexible zone 15a that permits it to be raised and lowered about trunnion 14. The ladder is swung from side to side by swinging movement of the hull about one of the anchor stakes at its rear end, either one of which is anchored in the floor of the water body, to thereby allow the suction head 16 to be located within a wide work area. Movement of the hull and suction tube ladder side to side may be accomplished in the convention manner, as by cables 17.

The flexible zone 15a of the suction tube ladder is flow connected with a suction pump 18 located inside pump housing, and which pump has a discharge line 19 leading from the hull assembly 11 to a point of sludge disposal. In use, the suction head 16 is carried into position in a work area and suction applied to the suction tube ladder 15 to draw slurry up through pump 18 for discharge.

Frequently it is most practical to draw slurry from a select area located on one side or the other of the suction head 16. Such side entrance of slurry into the suction tube ladder affords means to urge the suction head toward the work area selected thus increasing the effectiveness of the suction head.

The foregoing is accomplished by the use of the suction head best shown in FIGS. 2–4. As shown the suction head comprises a cast metal body having a neck portion 21 and a cross head inlet portion 22. The neck portion has a mounting flange 23 on its free end for attachment to the end of the suction tube ladder 15, and it is formed with an enlarged region 24 adjacent to cross head 22. The cross head portion 22 is divided into left and right hand portions by a central partition 22a.

A valve gate 25 mounted at one end on and rotatable with a stud shaft 26, has an arched segment 27 within the valve body. When the segment 27 is in the position shown in FIG. 4, the inlet on the left hand side of the cross head 22 is closed and all slurry entering the neck portion 21 flows throgh the right hand side of the cross head, as indicated by the flow arrows. With the valve gate in this position slurry is removed from the work area to the right of the sludge head. During suction withdrawal of slurry, when the valve element is in the aforesaid position, generates a suctional pull on the suction head which tends to continuously urge it towards the work area, as in the direction indicated by arrow L in FIG. 1.

When the work area is to the left of the suction head, the valve gate 27 is carried over to the right hand side of FIG. 4 to close the right hand inlet and open the left hand inlet. Movement of the valve gate 27 may be accomplished by means of a bevel gear 28 on valve shaft 26, which is meshed at all times with a complanion bevel gear 29, which is carried firmly on an elongated shaft 31 leading to the control center.

Figure 6:
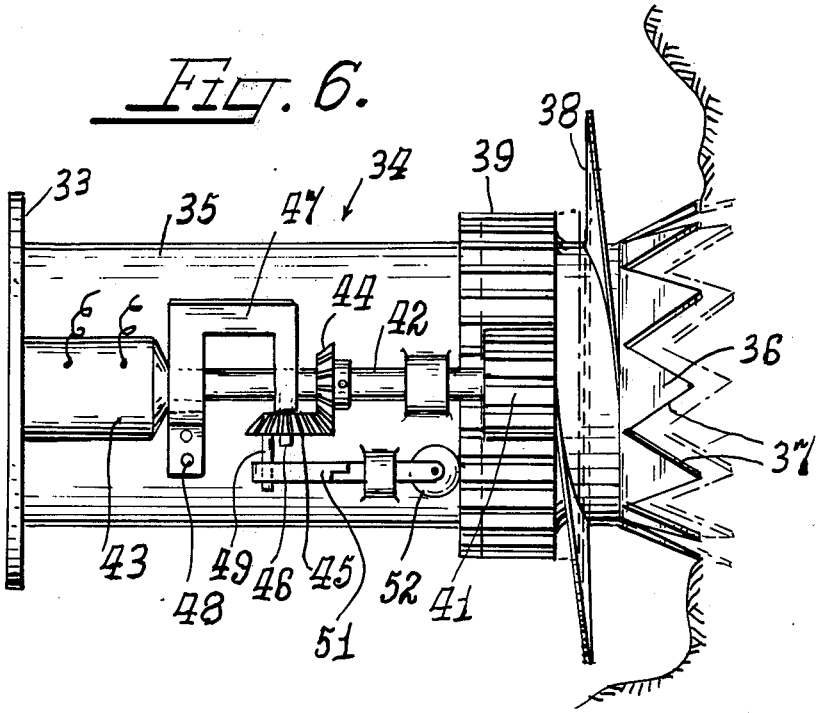
FIG. 6 is an enlarged detail view of the cutter head vibrating mechanism.

FIGS. 5 and 6 are representative of a cutter head forming a part of the suction head 16. Each end of the suction head 16 is externally flanged, as at 32, to which is secured a flange 33 on one end of a cutter assembly 34. Each assembly, includes a tubular body 35, carrying the flange 33, having on its front or free end a cutter 36 which includes cutting teeth 37, and a worm screw 38. The cutter 37 is adapted to be rotated through a gear 39 slidably mounted on the body 35 so as to be reciprocable in an axial direction during operation. The gear 39 is meshed at all times with a pinion 41 carred on a drive shaft 42 extending from an electric motor 43.

Frequently, the cutter encounters a hard work area, such as packed clay, and in order to quickly and efficiently loosen such clay, the cutterhead is reciprocable at all times. To this end, the shaft 42 carres a bevel gear 44 which meshes with a bevel gear 45 carried on a shaft 46 journalled, in this disclosure, in a bracket 47 secured to housing body 35 at 48. The gear 45 mounts an eccentric pin 49 connected with one end of an articulate rod 51, the other end of said rod carrying a roller 52 disposed adjacent to the related side face of gear 39. During rotation of shaft 42 the roller 52 repeatedly strikes the gear 39 causing it to be urged forward toward the work area to facilitate maximum cutting by the cutter teeth 37. At the same time, the worm screw 38 is functioning to drive the cutter further into the work area. As aconsequence, maximum efficiency in slurry and weed removal is obtained.

Although I have described preferred embodiments of my invention, in considerable detail, it will be understood that the description thereof is intended to be illustrative rather than restrictive, as details of the structure may be modified or changed without departing from the spirit or scope of the invention. Accordingly, I do not desire to be restricted to the exact constructions described and shown.

I claim:

1. In a hydraulic suction dredge, the combination of a suction tube ladder, a suction motor in said dredge, a suction head, said suction head having a neck at one end connected to said suction tube ladder and a tubular cross-head on the other end, said cross-head having an unrestricted opening at each end, a wall separating the cross-head from the neck, a central partition dividing said cross-head into two portions, passageways in said wall, one connecting each portion with the neck, an oscillatably rotatable T-shaped gate valve in said neck to manually selectively close either one of said passageways, said suction tube ladder and said cross-head converting suction developed by the suction motor into a linear force propelling the cross-head in a direction toward the open passageway, and a rotary cutter head, including augur means to advance the cross-head toward a work area, arranged on each open end of the cross-head.

2. The dredge recited in claim 1, wherein a flexible conduit connects one end of the suction tube ladder with said suction motor.

3. The dredge recited in claim 1, wherein the cross head is horizontally disposed.

4. The dredge recited in claim 1, wherein the rotary cutter head is cylindrical and includes circumferentially spaced teeth extending from one face thereof.

5. In the dredge recited in claim 1, wherein the valve means comprises a movable wall segment.

6. The dredge recited in claim 1, wherein power means is provided to rotate the cutter heads.

7. The dredge recited in claim 6, wherein the power means is carried on the cross head.

8. The dredge recited in claim 1, wherein there is additionally provided vibratory means to advance the cross head towards the work area.

9. In a hydraulic suction dredge, the combination of, a suction motor, a suction tube ladder in flow communication at one end with said suction motor, a suction head, said suction head having a neck at one end connected to said suction tube ladder and a horizontally disposed cross head at the other end, said cross head being open at its ends, a cylindrical rotatable cutter on each open end of the cross head, separate means on the cross head to rotate each cutter about its axis, circumferentially spaced cutter teeth on one end of each cutter head, and an auger on and rotatable with each cutter head closely adjacent to the cutter teeth thereon.

* * * * *